US005671810A

United States Patent [19]

Hodge et al.

[11] Patent Number: 5,671,810

[45] Date of Patent: Sep. 30, 1997

[54] COMPOSITION AND METHOD FOR RELIEF OF DIFFERENTIAL STICKING DURING DRILLING

[75] Inventors: Richard Hodge, Ponca City, Okla.; William S. Halliday; Thomas Daves, both of Houston, Tex.; Thomas Carter, Ponca City, Okla.

[73] Assignee: Baker Hughes Incorporated, Houston, Tex.

[21] Appl. No.: 558,271

[22] Filed: Nov. 13, 1995

[51] Int. Cl.[6] ..... E21B 21/00; E21B 31/03

[52] U.S. Cl. ..... 166/301; 507/260; 507/267; 507/910; 507/940

[58] Field of Search ..... 166/301; 175/64, 175/65; 507/103, 203, 260, 267, 910, 940

[56] References Cited

U.S. PATENT DOCUMENTS

| | | | |
|---|---|---|---|
| 2,216,955 | 10/1940 | Moore | 507/910 X |
| 2,890,753 | 6/1959 | White | 507/103 X |
| 3,099,624 | 7/1963 | Wilson | 166/301 X |
| 3,217,802 | 11/1965 | Reddie et al. | 166/301 |
| 3,233,622 | 2/1966 | Boothe . | |
| 3,850,817 | 11/1974 | Barthel . | |
| 4,230,587 | 10/1980 | Walker | 166/301 X |
| 4,427,564 | 1/1984 | Brownawell et al. | 166/301 X |
| 4,436,638 | 3/1984 | Walker et al. | 166/301 X |
| 4,464,269 | 8/1984 | Walker et al. | 166/301 X |
| 4,466,486 | 8/1984 | Walker | 166/301 |
| 4,614,235 | 9/1986 | Keener et al. | 166/301 |
| 4,631,136 | 12/1986 | Jones, III . | |
| 4,964,615 | 10/1990 | Mueller et al. | 507/940 X |
| 5,045,219 | 9/1991 | Trahan et al. | 507/940 X |
| 5,247,992 | 9/1993 | Lockhart | 166/301 |
| 5,556,832 | 9/1996 | Van Slyke | 507/203 |

OTHER PUBLICATIONS

Parker, Sybil P., *Dictionary of Scientific and Technical Terms*, Third Edition, McGraw–Hill Book Company, 1984, p. 590.

*Primary Examiner*—George A. Suchfield
*Attorney, Agent, or Firm*—Fishman, Dionne, Cantor & Colburn

[57] ABSTRACT

A composition and method for use in freeing differentially stuck pipes is presented, comprising a hydrocarbon, acetic acid and a surfactant. The composition frees stock pipes quickly, thus reducing down-time during the process of drilling a subterranean well.

11 Claims, No Drawings

COMPOSITION AND METHOD FOR RELIEF OF DIFFERENTIAL STICKING DURING DRILLING

BACKGROUND OF THE INVENTION

1. Field of the Invention

This invention relates to a material and method for drilling subterranean wells. More specifically, this invention relates to a composition and method for freeing differentially stuck pipes.

2. Prior Art

During the drilling of oil and gas wells, drilling fluid is circulated through the interior of the drill string and then back up to the surface through the annulus between the drill string and the wall of the borehole. The drilling fluid serves various purposes including lubricating the drill bit and pipe, carrying cuttings from the bottom of the well borehole to the surface of the ground and imposing a hydrostatic head on the formation being drilled to prevent the escape of oil, gas or water into the well borehole during the drilling operations.

Occasionally during drilling, the drill string becomes stuck and cannot be raised, lowered or rotated. There are numerous causes for this problem, one of the most common being differential sticking. Differential sticking usually occurs when drilling permeable formations and borehole pressures are greater than formation pressures and when the drill pipe remains at rest against the wall of the borehole for enough time to allow mud filter cake to build up around the pipe. The pressure exerted by drilling fluid then holds the pipe against the cake wall.

For a number of years, oil-based fluids have been popular both as drilling fluids and as stuck pipe fluids. These fluids typically are comprised of a hydrocarbon oil or oils as the major component of the liquid phase, to which various materials are added to impart the desired drilling fluid properties. These fluids are well adapted for use in underground formations containing water sensitive clays or shales which swell and disintegrate when contacted by water-based drilling fluids. Such fluids are substantially free of water, lose mostly oil as the filtrate and cause no swelling or disintegration of water sensitive clays and shales. One widely used oil-base fluid is described in U.S. Pat. No. 3,099,624, issued Jul. 30, 1963, to Doyne L. Wilson. Water-in-oil (invert) emulsions are also used as drilling fluids. These fluids contain a high percentage of oil and lesser percentage of water dispersed in the continuous or external phase of oil.

In order to free stuck pipe, prior art treatments involve the placement in and movement through the circulating mud system of a volume of a release agent, known as a spotting fluid, which is sufficient to fully contact the region of the borehole where the pipe is stuck. Thus, a suitably weighted oil-based fluid is circulated in the borehole to a position opposite the stuck interval. Over a period of time, the integrity of the mud filter cake between the drill pipe and borehole is reduced, allowing pressure equalization on all sides of the pipe. The invasion of oil into the filter cake is also thought to reduce the adhesive forces and lubricate the area between the pipe and borehole, resulting in less friction and quicker release.

Conventional oil-based formulations used in the past as spotting fluids are described, for instance, in U.S. Pat. Nos. 4,436,638 and 4,464,269. Water-based formulations are also known for use in releasing differentially stuck pipe. They are described, for instance, in U.S. Pat. Nos. 3,233,622; 4,230,587; 4,466,486; and 4,614,235. An invert emulsion drilling fluid, also useful as a spotting fluid, has been described in U.S. Pat. No. 3,850,817.

However, these and other spotting fluids suffer from toxicity problems. More stringent environmental regulations require the development of environmentally acceptable spotting fluids with performance approaching that of conventional oil-based products. A spotting fluid having a diesel oil component may still be used, but at least fifty (50) barrels on either side of the fluid pill, in addition to the pill itself, must be removed from the active system and may not be discharged into the waters of the United States. If the remaining diesel channeled into the active system creates a sheen upon discharge, or has a toxicity ≧30,000 ppm for the suspended particulate phase, the entire mud system used in offshore drilling must be sent ashore for disposal after use of a conventional spotting fluid.

In addition, the amount of down-time resulting from stuck pipes can add considerable cost to the well-drilling process. Conventional spotting fluids can take many hours or even days to be effective, adding to this cost. Thus, there remains a need for spotting fluids that work quickly, have low toxicity, water miscibility, adequate barite suspension, no adverse effect on drilling fluid properties, and moderate cost.

SUMMARY OF THE INVENTION

The above-discussed and other problems and deficiencies of the prior art are overcome or alleviated by the composition and method of the present invention, which dissolves the filter cake surrounding a differentially stuck drill string and casing in the wellbore of a subterranean well. In one embodiment, the composition comprises a hydrocarbon or off-shore approved synthetic oil and an acid. In an alternative embodiment, the composition further comprises at least one surfactant.

In still another alternative embodiment, the present invention comprises a method for releasing a stuck drill assembly in a downhole well drilling operation comprising the steps of preparing the spotting fluid composition described above; displacing a drilling fluid from the well with the spotting fluid composition in an amount sufficient to contact the filter cake with the composition; dissolving the filter cake; and circulating the drilling fluid to incorporate the composition into the fluid. The method may also include vertically working the drill assembly during the initial displacing step; and further removing the drill assembly prior to the circulating step and staging back into the well with the freed drill assembly.

The present invention thus provides a composition that works quickly, is easy to prepare, has good compatibility with drilling fluids, low toxicity, and moderate cost. It is capable of being disposed of at the drill site without costly procedures.

The above-discussed and other features and advantages of the present invention will be appreciated and understood by those skilled in the art from the following detailed description.

DESCRIPTION OF THE PREFERRED EMBODIMENT

The present invention discloses a spotting fluid composition for dissolving filter cakes, comprising a hydrocarbon or offshore-approved synthetic oil and an acid. Preferably, the composition further comprises at least one surfactant.

The hydrocarbon or offshore-approved synthetic oil of this invention may be any hydrocarbon compatible with the circulating drilling fluid, including but not limited to diesel oil, crude oil, kerosene, mineral oil, offshore-approved synthetic oils, and the like. Preferably, the amount of hydrocarbon comprises in the range from about 10 to about 90 percent of the total composition by weight. Most preferably, the amount of hydrocarbon comprises in the amount of about 48% of the total composition by weight.

The acid component of the present invention preferably comprises from about 80 to about 10 percent of the total composition by weight. Most preferably, the acid is acetic acid, and comprises about 52% of the total composition by weight. Importantly, the acetic acid serves to dissolve the filter cake that contributes to differential sticking, allowing the other components of the spotting fluid to surround and coat the stuck drill pipe more quickly. Thus, this invention is preferred for use with systems that form filter cakes dissolvable by acids, preferably dissolvable by acetic acid. An example of such a system is the PERFFLOW system, a drilling fluid loss, and, containing calcium carbonate as the primary bridging material. PERFFLOW is trademark of Baker Hughes, Inc. of Houston, Tex.

Acetic acid is soluble in the hydrocarbons used with spotting fluids and in drilling muds, thereby allowing easy preparation and delivery to the filter cake. Accordingly, other hydrocarbon soluble acids may be used in the practice of the present invention, including but not limited to, benzoic acid, acrylic acid, formic acid, propionic acid butyric acid, and other monocarboxylic acids containing up to 20 carbon atoms. In addition, polycarboxylic acids containing up to 20 carbon atoms may be used in the practice of the present invention, for example, dicarboxylic acids. While the use of hydrocarbon-soluble acids is preferred, other acids deliverable to the filter cake, and capable of dissolving an acid-soluble filter cake may also be used in the practice of the present invention.

The surfactant component may be any surfactant compatible with the hydrocarbon component and drilling mud system, including but not limited to those well known in the art such as zwitterions; anionic surfactants, such as carboxylic acid salts, sulfonic acid salts, sulfuric acid ester salts; phosphoric and polyphosphoric acid esters, and perfluorinated anionics; cationics, such as long-chain amines and their salts, diamines and polyamines and their salts, quaternary ammonium salts, polyoxyethylenated long-chain amines, and amine oxides; and nonionic surfactants such as polyoxyethylenated alkyphenols and alkylphenol ethoxylates, polyoxyethylenated straight-chain alcohols and alcohol ethoxylates, polyoxyethylenated mercaptans, long-chain carboxylic acid esters, alkanolamine "condensates" and alkanolamides, and tertiary acetylenic glycols.

A combination of surfactants may also be used. Preferably the surfactant is a fatty acid surfactant, and comprises in the range from about 0.5 to about 20 percent of the total composition by weight, and most preferably comprises about 2 percent of the total composition by weight.

In practicing the method of the present invention, a spotting fluid pill comprising the composition of the present invention is prepared. The finished spotting fluid should be pumped down the drill string into the open hole in sufficient quantity to immerse the entire annular interval affected. The pill should be delivered within 1 to 12 hours for best results. The affected region is typically soaked with the fluid until the pipe is freed. An additional quantity of fluid should be pumped periodically to insure adequate soaking and the string should be worked vertically. Generally, an additional ½ to 2 barrels of fluid are pumped per hour, preferably an additional ½ to 1 barrel of fluid are pumped, and optimally about 1 barrel is pumped per hour. When the pipe is free, it is pulled up from the problem zone leaving the spotting fluid to lubricate and seal the low pressure sand formation. The drill string is staged back into the hole and the drilling fluid is circulated to incorporate the spotting fluid pill as lubricant on the mud. The mud may be further conditioned with alkalinity control agent, thinner, defoamer and the like as needed.

The present invention is further illustrated by the following example, wherein an operator was drilling a 6¾" wellbore to 9,400 feet in Tepetate field, Acadia Parish, La. and the pipe became stuck. Initial spotting was with a 35 bbl pill of PERFFLOW containing 15% by volume BIO-DRILL, with soaking for 5 hours while working the drill string. BIO-DRILL is a synthetic oil drilling mud available from Baker Hughes Inteq, Houston, Tex. A pill containing 40 bbl No. 2 diesel oil and 110 gallons of spotting fluid surfactant was then prepared, and five bbls of spot was spotted in the open hole and pumped in at the rate of approximately ½ bbl every 30 minutes, while the pipe was worked. A Weatherford was then rigged up, and a set of jars, but after 12 hours of jarring and working the pipe, no effect was seen.

The spotting fluid of the present invention was then employed, consisting of 12 barrels of No. 2 diesel oil, 12 barrels of acetic acid and 1 bbl of stuck pipe surfactant. 10 bbls of No. 2 diesel oil were pumped as a spacer both before and after the pill. The pill was pumped at 86 strokes per minute down the drill pipe to help prevent channeling. Ten bbls of spotting fluid were pumped out of the drill pipe into the annulus around the bottom hole assembly, and jarring and working the pipe were commenced. The pipe became free after approximately 45 minutes. This example demonstrates that the present invention provides a composition that is works quickly, is easy to prepare, and has good compatibility with drilling fluids. Furthermore, it is non-toxic, and of moderate cost. It is capable of being disposed of at the drill site without costly procedures.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A spotting fluid composition suitable for use in downhole drilling operations in a pill for releasing periodically stuck drill string or casing comprising:

(a) a hydrocarbon; and (b) an acid in an amount effective to release periodically stuck drillstring or casing by dissolution of the filter cake, said acid being selected from the group comprising monocarboxylic acids having up to nine carbon atoms, and polycarboxylic acids having up to 20 carbon atoms.

2. The composition of claim 1, further comprising at least one surfactant.

3. The composition of claim 1 wherein:

said hydrocarbon is selected from a group consisting of diesel oil, crude oil, kerosene oil, mineral oil and synthetic oils such as polyalphaolefins and isomerized alpha olefins.

4. The composition of claim 1, wherein:

said acid comprises acetic acid.

5. The composition of claim 1, wherein:

said hydrocarbons comprise in the range from about 10% to about 90% of the total composition by weight, and said acid comprises in the range from about 10% to about 80% of the total composition by weight.

6. The composition of claim 2, wherein:

said hydrocarbon comprises about 40% of the total composition by weight, said acid comprises about 52% of the total composition by weight, and said surfactant comprises about 8% of the total composition by weight.

7. The composition of claim 2, wherein:

said surfactant comprises in the range from about 0.5% to about 20% of the total composition by weight.

8. An improved method of releasing a stuck drill string in the borehole of an underground formation during drilling operations employing an aqueous drilling fluid which comprises contacting said stuck drill string with an additive composition effective to reduce the annular pressure exerted by the drilling fluid against the stuck drill string and to release said stuck drill string, said additive composition comprising:

(a) a hydrocarbon; and (b) an acid in an amount effective to release periodically stuck drillstring or casing by dissolution of the filter cake, said acid being selected from the group comprising monocarboxylic acids having up to nine carbon atoms, and polycarboxylic acids having up to 20 carbon atoms.

9. The method of claim 8, wherein:

said composition further comprises at least one surfactant.

10. A spotting fluid composition suitable for use in downhole drilling operations in a pill for releasing periodically stuck drill string or casing comprising:

(a) a hydrocarbon; and (b) a hydrocarbon soluble acid, namely acetic acid, in an amount effective to release periodically stuck drillstring or casing.

11. An improved method of releasing a stuck drill string in the borehole of an underground formation during drilling operations employing an aqueous drilling fluid which comprises contacting said stuck drill string with an additive composition effective to reduce the annular pressure exerted by the drilling fluid against the stuck drill string and to release said stuck drill string, said additive composition comprising:

(a) a hydrocarbon; and (b) a hydrocarbon soluble acid, namely acetic acid, in an amount effective to release periodically stuck drillstring or casing.

* * * * *